United States Patent [19]

Watts

[11] 4,270,779

[45] Jun. 2, 1981

[54] LOCKING DEVICE FOR REMOVABLE FRAME STRUCTURES

[76] Inventor: John R. Watts, 18 Hammond St., Brighton, 3186, Australia

[21] Appl. No.: 40,322

[22] Filed: May 18, 1979

[51] Int. Cl.[3] ..... E05C 1/04

[52] U.S. Cl. ..... 292/175

[58] Field of Search ..... 49/450; 292/175, 251.5, 292/145, 146, 138, 171, 164

[56] References Cited

FOREIGN PATENT DOCUMENTS 1252992 12/1960 France ..... 292/251.5

1258870 3/1961 France ..... 292/251.5

*Primary Examiner*—Richard E. Moore

*Attorney, Agent, or Firm*—Francis X. LoJacono

[57] ABSTRACT

A locking device for removable frame structures, and more particularly for use in conjunction with fly-wire screens, wherein the device comprises a spring-biased pin having an elongated shank member including an enlarged-diameter, shorter length head member having one or more protrusion members projecting radially outwardly from the surface of its general configuration, the shank member being adapted to receive a coil spring thereover to allow the pin to be spring-loaded once the pin and the spring are force-fitted and retained in the frame structure by the protrusions.

4 Claims, 5 Drawing Figures

FIG. 1
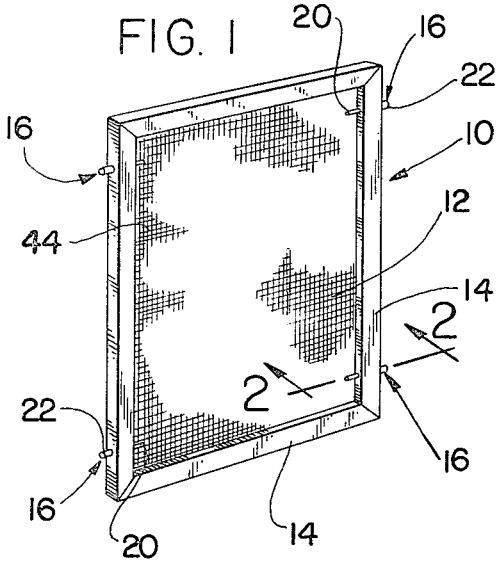
FIG. 5
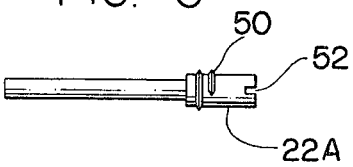
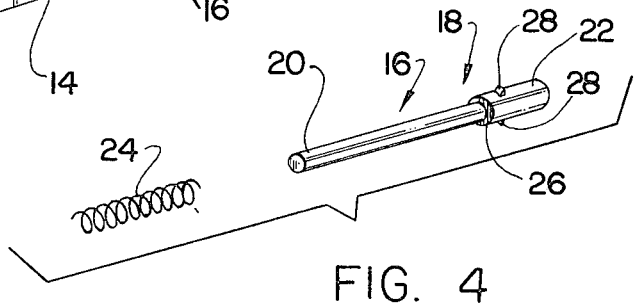
FIG. 4
FIG. 2
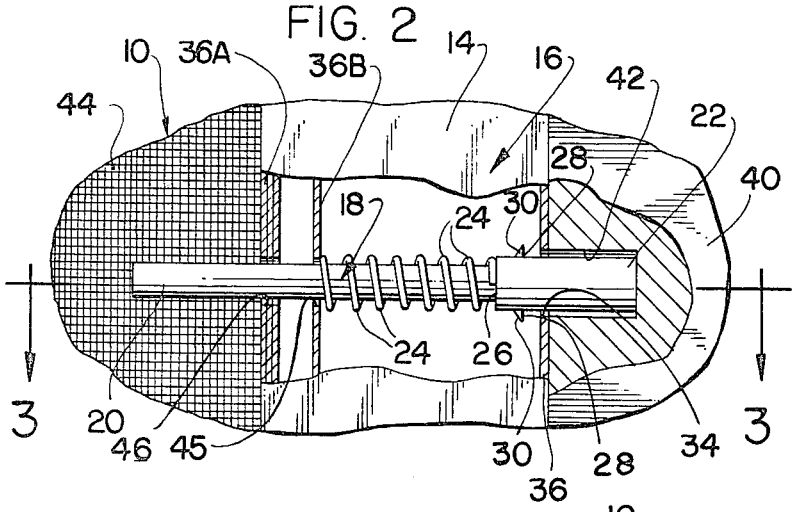
FIG. 3
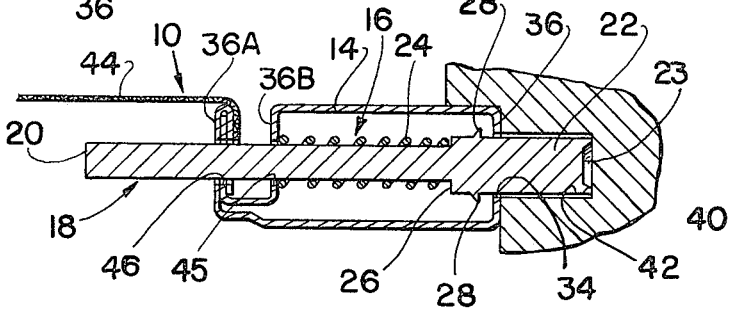

LOCKING DEVICE FOR REMOVABLE FRAME STRUCTURES

BACKGROUND OF THE INVENTION

The invention relates to improvements in fastening and/or locking devices, and more particularly to locking devices used in conjunction with fly-wire screens and other similar applications.

In practice, it has been found that the fastening slide comprised of a number of separate components requiring assembly at the time of attachment to screen structures involves an inefficient and undesirable use of labor and time; and the requirement of a multiplicity of components results in other undesirable costs also.

The above-mentioned fastening device and alternative plastic one-piece slide both are deficient in that they lack the axial strength required for fastening into wood window frames in the most preferred manner of being driven by a hammer.

The plastic one-piece-type fastening device has also proved to be deficient in that it loses screen-retention ability under conditions of screen vibration and movement induced by wind, as a result of its being displaced into the screen frame and away from the window frame hole in which it should remain embedded. The lack of a return spring to return the pin to a sufficiently protruding position from the screen frame results in the pin permanently adopting a position where its retention ability has been reduced.

SUMMARY AND OBJECTS OF THE INVENTION

The present invention has for an important object to provide a fastening or locking device which is simple and quick to install in fly-screen structures, and which also enables a screen to be quickly fastened or locked into place within a window-frame structure.

It is another object of the invention to provide a fastening or locking device of this character that is corrosion resistant, of pleasing appearance, and resistant to loosening by vibration.

It is a further object of the invention to provide a locking device for screens and the like that requires few operating parts, and is easy to service and maintain.

Still another object of the invention is to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a perspective view of a typical screen having a screen-frame structure including therein the present invention;

FIG. 2 is an enlarged cross-sectional view taken substantially along line 2—2 of FIG. 1, wherein the pin head is engaged in the adjacent window-frame structure;

FIG. 3 is a cross-sectional view taken substantially along line 3—3 of FIG. 2;

FIG. 4 is an exploded view of the locking pin and its associated spring; and FIG. 5 is an alternative arrangement of the locking pin.

DESCRIPTION OF THE PREFERRED EMBODIMENT

Referring more particularly to FIG. 1, there is shown a fly-screen, generally indicated at 10, having suitable screening 12 supported in a screen-frame structure 14 wherein a plurality of fastener or locking devices 16 are operably disposed. It should be understood that the number of locking devices 16 will be determined, if necessary, by the size of screen 10. Thus, the four illustrated locks are shown as an example only. In FIGS. 2, 3 and 4, the locking device 16 is shown as comprising a pin member 18 defined by an elongated shank 20 integrally formed having an enlarged-diameter head 22 which is shorter in length than shank 20. Assembled on the shaft of shank 20 is a biasing means represented by spring 24, which in the free state is longitudinally deformed—that is, curved along its axis—so as to provide, by bend of friction, the straightening required to slide spring 24 onto shank 20, thus providing a force-resistance of relative sliding motion of the spring along the shaft of the shank, so that under conditions of transport and assembly the spring will not be lost or become separated from the shaft. The end of spring 24 nearest head 22 has its relative movement with the shaft in a direction towards the head prevented by the ledge or shoulder 26, which is formed as a result of the difference in diameter between shank 20 and enlarged head 22. Compression of spring in application, therefore, results in the spring applying a force to pin 18, with the point of application being provided at shoulder 26 under head 22 in a direction from shank to head.

Head 22 further includes at least one protrusion, indicated at 28. However, as seen in FIGS. 2, 3 and 4, head 22 is provided with a pair of oppositely disposed and radially extended protrusions forming lug members, the lugs 28 being shown having —preferably but not essentially—an inclined ramp surface 30. This configuration minimizes the force required to drive pin head 22 with protrusion lugs 28 through hole 34 located along the outer wall 36 of screen frame 14, hole 34 having a diameter slightly larger than the diameter of head 22, thus permitting protrusion lug or lugs 28 to suitably deform hole 34 in the area of the protrusions, so as to permit head 22 with the protrusions to pass through into frame section 14. The peripheral area of the hole through which the protrusions are driven are deformed by force, since the hole in the frame section is not large enough to permit the free passage of the head at the cross sections where protrusions 28 exist. After passage of protrusion lugs 28 through wall 36, the deformed hole 34 has a size slightly smaller than the maximum size hole which existed in the wall at any one time when the protrusions were passing through as a result of the elasticity of the screen wall and the protrusions. Therefore, the pin cannot be withdrawn through the hole without sufficient force being applied to cause hole 34 to enlarge sufficiently to allow the protrusion lugs 28 to pass back through the hole. Retention in hole 34 is further increased if pin rotation occurs after the pin protrusion lugs have been forced through the section wall, as will often be the case.

The external or the free end of pin head 22 includes a central recess 23, as seen in FIG. 3., which acts as a punch so that, when the head is driven into the wood frame 40, a neat hole 42 is made. Thus, extra drilling and aligning of hole 42 is not required.

A typical screen section, as indicated in FIG. 3, generally includes wall 36 which—when in use—would be positioned adjacent window-frame structure 40; while the inside wall 36A is adapted to receive and retain the screen mesh 44.

When the locking device 16 is positioned within screen section 14, the compression spring 24 presses against wall 36B of section 14 and shoulder 26 of head 22, whereby the force of spring 24 causes head 22 to extend outwardly through hole 34 in wall 36 into which it was originally driven, with protrusion lugs 28 preventing head 22 from leaving the hole. When a screen is installed in the window frame 40, this outward force maintains the recess end 23 of head 22 against the window frame or in hole 42 made in the frame, or behind the ledge located on some window frames; so that lateral movement between the pin and the window frame is impeded, and this in turn results in the lateral movement between the frame and screen being impeded, thus maintaining the screen in the window frame.

Accordingly, shank 20 extends longitudinally through holes 45 and 46, respectively disposed in walls 36A and 36B, thus allowing the shank to be gripped by the hand for operation of the biased pin when screen removal is required.

In the preferred configuration, the protrusions take the form of ramps, projecting radially outward from the head's cylindrical surface, and having small widths in a tangential direction. However, a particular alternative embodiment of the invention, as illustrated in FIG. 5, comprises a protrusion means taking the form of a screw thread 50; and the tips of the thread protrude radially outward from the general cylindrical shape of the pin head 22A. The recess could then incorporate a slot or cross 52 to accommodate a screwdriver point, to enable the pin to be applied to the screen by the simultaneous actions of rotation and longitudinal movement, as would be imparted by the screwdriver. Such a pin can also be installed in a screen section by a larger longitudinal force only, as is previously described in this application.

In this case also, pin rotation—after all the threaded length has passed through the section wall—very much reduces the possibility of the pin leaving the section under normal conditions of handling and transport, since thread alignment is lost between the pin thread 50 and the peripheral area of the screen section hole 34.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A locking device for fly screen and like frame structures comprising a pin member adapted to be spring-biased within a frame section of said frame structure, said pin defined by an elongated shank member of a predetermined diameter and a head member having at least one radially extended protrusion projecting from the side of said head, said head having a diameter larger than that of said shank member, and including a biasing spring means adapted to force said head member into a locking position and extending outwardly from said frame section, wherein said spring means includes a coil spring in which said spring has a longitudinal axis which is of a curved configuration in the undeformed state, whereby the forces created thereby maintain said spring in a substantially straightened configuration providing frictional force between said spring and said shank, thus preventing longitudinal motion therebetween prior to said pin and said spring being assembled within said frame section.

2. A locking device for fly screen and like frame structures comprising a pin member adapted to be spring-biased within a frame section of said frame structure, said pin defined by an elongated shank member of a predetermined diameter and a head member having at least one radially extended protrusion, wherein said protrusion comprises a pair of radially-outward-projecting lug members projecting from the side of said head, said head having a diameter larger than that of said shank member, and including a biasing spring means adapted to force said head member into a locking position and extending outwardly from said frame section.

3. A locking device as recited in claim 2, wherein said lug members are provided with an inclined surface.

4. A locking device for fly screen and like frame structures comprising a pin member adapted to be spring-biased within a frame section of said frame structure, said pin defined by an elongaged shank member of a predetermined diameter and a head member having at least one radially extended protrusion, wherein said protrusion comprises a radially projecting screw thread and a slot formed in said free end of said head member projecting from the side of said head, said head having a diameter larger than that of said shank member, and including a biasing spring means adapted to force said head member into a locking position and extending outwardly from said frame section.

* * * * *